US008120252B2

(12) United States Patent
Cho et al.

(10) Patent No.: US 8,120,252 B2
(45) Date of Patent: Feb. 21, 2012

(54) PLASMA DISPLAY PANEL

(75) Inventors: Sung-Hee Cho, Suwon-si (KR); Jung-Min Kim, Suwon-si (KR)

(73) Assignee: Samsung SDI Co., Ltd., Gyeonggi-do (KR)

( * ) Notice: Subject to any disclaimer, the term of this patent is extended or adjusted under 35 U.S.C. 154(b) by 57 days.

(21) Appl. No.: 12/820,989

(22) Filed: Jun. 22, 2010

(65) Prior Publication Data

US 2011/0068677 A1 Mar. 24, 2011

(30) Foreign Application Priority Data

Sep. 24, 2009 (KR) ..... 10-2009-0090558

(51) Int. Cl.
*H01J 1/62* (2006.01)

(52) U.S. Cl. ..... 313/582; 313/584

(58) Field of Classification Search ..... 313/582–586, 313/292

See application file for complete search history.

(56) References Cited

U.S. PATENT DOCUMENTS

2006/0166113 A1 7/2006 Lee et al.

FOREIGN PATENT DOCUMENTS

| | | | |
|---|---|---|---|
| JP | 08-167380 | | 6/1996 |
| JP | 2003-031130 | | 1/2003 |
| JP | 2004-342447 | | 12/2004 |
| JP | 2005-174850 | A | 6/2005 |
| JP | 2006-024408 | A | 1/2006 |
| KP | 1020030013990 | A | 2/2003 |
| KP | 1020030093549 | A | 12/2003 |
| KR | 10-2006-0080405 | A | 7/2006 |

*Primary Examiner* — Vip Patel

(74) *Attorney, Agent, or Firm* — Knobbe, Martens, Olson & Bear LLP

(57) ABSTRACT

A plasma display panel (PDP) is disclosed. In one embodiment, the PDP includes i) a front substrate and a rear substrate spaced apart from and facing each other and ii) a barrier rib portion dividing a space between the front substrate and the rear substrate into a plurality of discharge cells, wherein the barrier rib portion comprises first barrier ribs and second barrier ribs formed on the first barrier ribs, wherein the second barrier ribs are less in width than the first barrier ribs, wherein the widths of the first and second barrier ribs are defined along a first direction substantially parallel with one of the front and rear substrates, and wherein the second barrier ribs are closer to the first substrate than the first barrier ribs. The PDP may further include i) an anti-reflection layer formed on the second barrier ribs, ii) a plurality of discharge electrodes separately disposed on the front substrate substantially in parallel with each other across the front substrate, iii) a plurality of address electrodes formed on the rear substrate to cross the discharge electrodes, iv) phosphors formed in the discharge cells and v) a discharge gas filled in the discharge cells.

15 Claims, 4 Drawing Sheets

PLASMA DISPLAY PANEL

RELATED APPLICATIONS

This application claims the benefit of Korean Patent Application No. 10-2009-090558, filed on Sep. 24, 2009, in the Korean Intellectual Property Office, the disclosures of which are incorporated herein in their entirety by reference.

BACKGROUND

1. Field

One or more embodiments of the present invention relate to a plasma display panel, and more particularly, to a plasma display panel with improved contrast and discharging efficiency.

2. Description of the Related Technology

Plasma display apparatuses, including plasma display panels, are flat panel display apparatuses that display images using a gas discharge, and have superior properties in terms of brightness, contrast, residual images, and viewing angle. In addition, plasma display apparatuses have large screens that are thin and light weight. Therefore, plasma display apparatuses are considered as the next generation of large flat panel display apparatuses.

SUMMARY OF CERTAIN INVENTIVE ASPECTS

One or more embodiments of the present invention include a plasma display panel (PDP) with improved contrast and discharging efficiency.

According to one or more embodiments of the present invention, a plasma display panel (PDP) includes: a front substrate and a rear substrate facing each other; a barrier rib portion dividing a space between the front substrate and the rear substrate into a plurality of discharge cells and including first barrier ribs and second barrier ribs formed on the first barrier ribs, wherein the second barrier ribs have widths narrower than widths of the first barrier ribs; an anti-reflection layer formed on the second barrier ribs; a plurality of discharge electrodes separately disposed on the front substrate in parallel with each other across the front substrate; a plurality of address electrodes formed on the rear substrate to cross the discharge electrodes; phosphors applied in the discharge cells; and a discharge gas filled in the discharge cells.

The first barrier ribs may be symmetrically disposed on both sides of a main discharge space in the discharge cells, and a stepped space may be formed with stepped surfaces of the first barrier ribs and the second barrier ribs.

The main discharge space and the stepped space may be connected to each other to form each of the discharge cells.

Each of the discharge electrodes may include a pair of transparent electrodes and a pair of bus electrodes, and each of the bus electrodes comprises an external light absorbing material.

The barrier rib portion may include transverse barrier ribs extending in a direction and comprising the first barrier ribs and the second barrier ribs, and longitudinal barrier ribs extending in a direction different to the transverse barrier ribs.

The anti-reflection layer may be formed on the longitudinal barrier ribs.

The barrier rib portion may include a photosensitive material.

Non-discharge areas may be formed adjacent to the discharge cells, and the anti-reflection layer may be formed on the non-discharge areas.

The PDP may further include third barrier ribs extending from the first barrier ribs on bottom surfaces of the non-discharge areas, and the anti-reflection layer may be formed on upper portions of the third barrier ribs.

The anti-reflection layer may be black. Another aspect is a plasma display panel (PDP) comprising: a front substrate and a rear substrate spaced apart from and facing each other; a barrier rib portion dividing a space between the front substrate and the rear substrate into a plurality of discharge cells, wherein the barrier rib portion comprises first barrier ribs and second barrier ribs formed on the first barrier ribs, wherein the second barrier ribs are less in width than the first barrier ribs, wherein the widths of the first and second barrier ribs are defined along a first direction substantially parallel with one of the front and rear substrates, and wherein the second barrier ribs are closer to the first substrate than the first barrier ribs; an anti-reflection layer formed on the second barrier ribs; a plurality of discharge electrodes separately disposed on the front substrate substantially in parallel with each other across the front substrate; a plurality of address electrodes formed on the rear substrate to cross the discharge electrodes; phosphors formed in the discharge cells; and a discharge gas filled in the discharge cells.

In the above PDP, the second barrier ribs are greater in height than the first barrier ribs, and wherein the heights of the first and second barrier ribs are defined along a second direction substantially perpendicular to the first direction. In the above PDP, each of the first barrier ribs comprises a slanted surface. In the above PDP, the slanted surface forms an obtuse angle with respect to the rear substrate. In the above PDP, each of the first barrier ribs comprises a pair of slanted surfaces which face slanted surfaces of adjacent first barrier ribs, respectively. In the above PDP, the space comprises a main discharge space and an auxiliary discharge space, wherein the volume of the main discharge space is greater than that of the auxiliary discharge space, wherein the first barrier ribs are substantially symmetrically disposed on both sides of the main discharge space in the discharge cells, and wherein the auxiliary discharge space comprises stepped surfaces of the first barrier ribs and the second barrier ribs.

In the above PDP, the main discharge space and the auxiliary discharge space are connected to each other to form each of the discharge cells. In the above PDP, each of the discharge electrodes comprises a pair of transparent electrodes and a pair of bus electrodes, and wherein each of the bus electrodes comprises an external light absorbing material. In the above PDP, the barrier rib portion comprises i) transverse barrier ribs which extend in a direction and include the first barrier ribs and the second barrier ribs, and ii) longitudinal barrier ribs extending in a direction different to the transverse barrier ribs.

In the above PDP, the anti-reflection layer is formed on the longitudinal barrier ribs. In the above PDP, the barrier rib portion comprises a photosensitive material. In the above PDP, non-discharge areas are formed adjacent to the discharge cells, and wherein the anti-reflection layer is formed on the non-discharge areas. The above PDP further comprises third barrier ribs extending from the first barrier ribs on bottom surfaces of the non-discharge areas, wherein the anti-reflection layer is formed on upper portions of the third barrier ribs. In the above PDP, the anti-reflection layer is black in color.

Another aspect is a plasma display panel (PDP) comprising: first and second substrate spaced apart from and opposing each other, wherein the first substrate is configured to display an image; a barrier rib formed between the first and second substrates and defining a plurality of discharge cells, wherein the barrier rib comprises a plurality of first sub-barrier ribs and a plurality of second sub-barrier ribs, wherein each of the second sub-barrier ribs comprises i) a bottom surface connected to the respective first sub-barrier rib and ii) a top surface opposing the bottom surfaces, wherein the top surface is closer to the first substrate than the bottom surface, and wherein each of the first sub-barrier ribs comprises a slanted surface; and an anti-reflection layer formed on the top surfaces of the second sub-barrier ribs.

In the above PDP, the second sub-barrier ribs are less in width than the first sub-barrier ribs, wherein the second sub-barrier ribs are greater in height than the first sub-barrier ribs, wherein the widths of the first and second sub-barrier ribs are defined along a first direction substantially parallel with one of the first and second substrates, and wherein the heights of the first and second sub-barrier ribs are defined along a second direction substantially perpendicular to the first direction.

In the above PDP, the slanted surface forms an obtuse angle with respect to the second substrate. In the above PDP, each of the first sub-barrier ribs comprises a pair of slanted surfaces which face slanted surfaces of adjacent first barrier ribs, respectively. In the above PDP, each of the discharge cells comprises a main discharge space and an auxiliary discharge space, wherein the first barrier ribs are substantially symmetrically disposed on both sides of the main discharge space in the discharge cells, and wherein the auxiliary discharge space comprises stepped surfaces of the first barrier ribs and the second barrier ribs. In the above PDP, the volume of the main discharge space is greater than that of the auxiliary discharge space, and wherein the main discharge space and the auxiliary discharge are connected to each other to form each of the discharge cells.

DETAILED DESCRIPTION OF CERTAIN INVENTIVE ASPECTS

Figure 1:
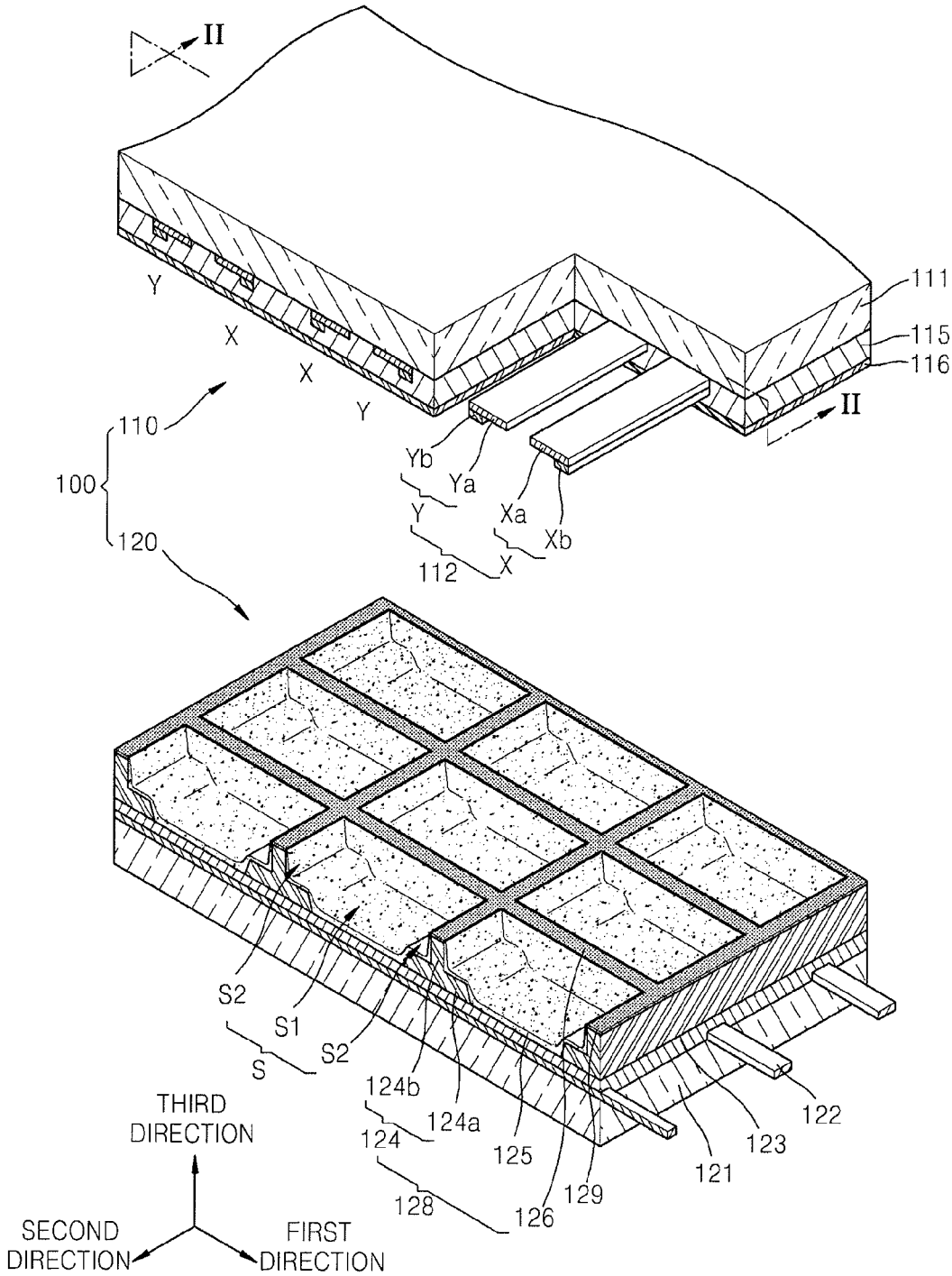
FIG. 1 is a schematic perspective view of a plasma display panel (PDP) according to an embodiment of the present invention.

In a general plasma display panel (PDP), discharge electrodes, each including a pair of a transparent X electrode and Y electrode, corresponding to display electrodes are formed on an inner surface of a front glass substrate, and address electrodes are formed on an inner surface of a rear glass substrate. A sustain discharge occurs between the X and Y electrodes included in the discharge electrodes during the operation of the general PDP.

While using a plasma display apparatus using the PDP, when external light is incident on the PDP and reflected by the PDP, the reflected light affects visible rays generated from the PDP by the gas discharge. Consequently, contrast of the plasma display apparatus is reduced, and image quality of the plasma display apparatus is degraded.

The above-described problem becomes apparent especially when ambient light is reflected by upper surfaces of the barrier ribs, that define individual discharge cells.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

Figure 2:
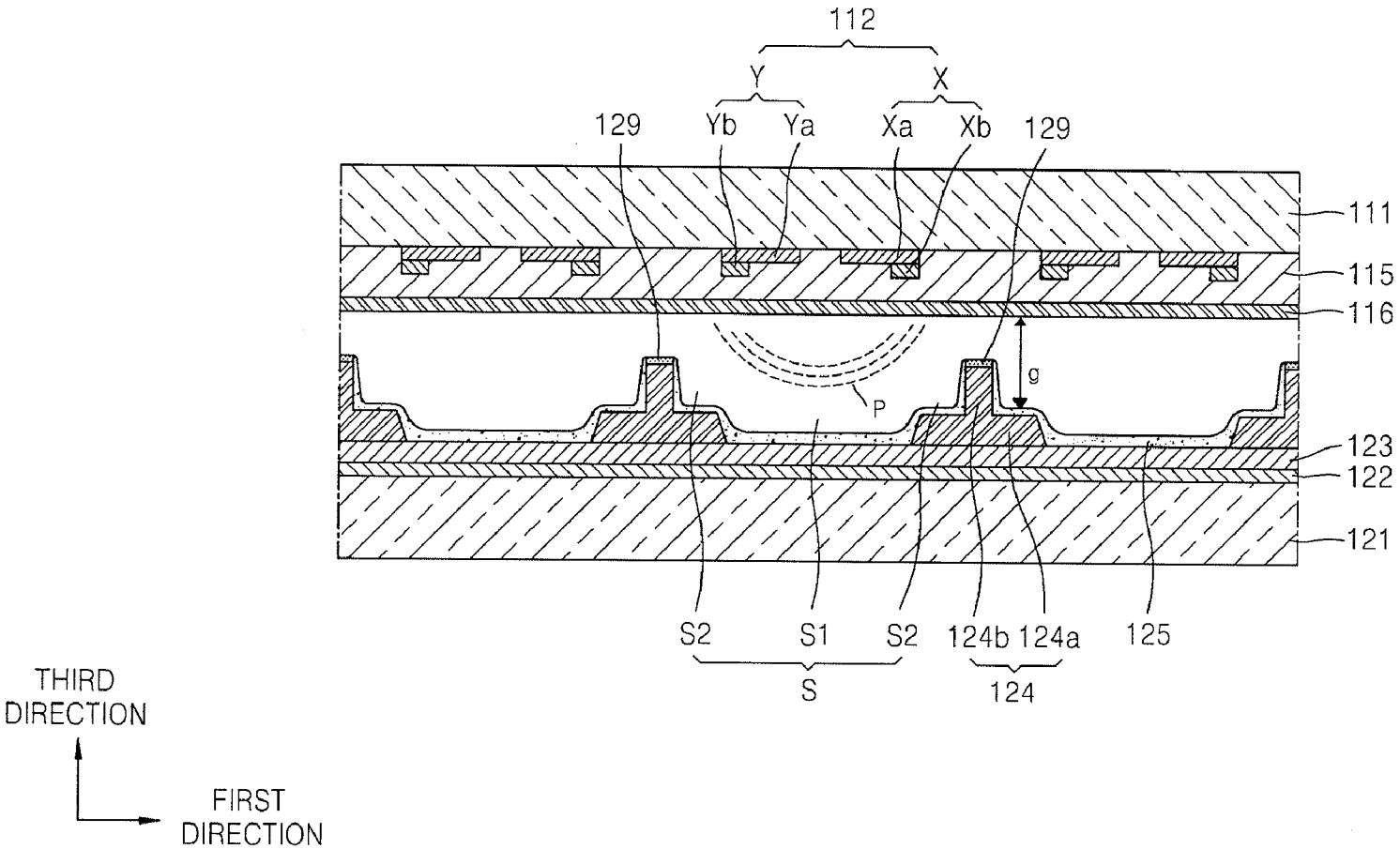
FIG. 2 is a partial cross-sectional view of the PDP taken along line II-II of FIG. 1.

FIG. 1 is a schematic perspective view of a plasma display panel (PDP) 100 according to an embodiment of the present invention, and FIG. 2 is a partial cross-sectional view of the PDP 100 taken along line II-II of FIG. 1.

The PDP 100 includes a front panel 110 and a rear panel 120 which face each other. The front panel 110 may include a front substrate 111, discharge electrodes 112, a front dielectric layer 115, and a protective layer 116. The rear panel 120 may include a rear substrate 121, address electrodes 122, a rear dielectric layer 123, a barrier rib portion 128, a phosphor 125, and an anti-reflection layer 129. In addition, discharge gas is filled in a space between the front panel 110 and the rear panel 120. Hereinafter, the PDP 100 will be described in more detail.

The front substrate 111 may be formed of a material including glass having a high transmittance to visible rays. However, the front substrate 111 may be tinted in order to improve a bright room contrast. The front substrate 111 may display an image.

The rear substrate 121 is disposed a predetermined distance apart from the front substrate 111, and may be formed of a material including glass. In addition, the rear substrate 121 may be tinted in order to improve the bright room contrast, like the front substrate 111.

The barrier rib portion 128 is disposed between the front substrate 111 and the rear substrate 121.

The barrier rib portion 128 is disposed between the front substrate 111 and the rear substrate 121 to divide a space between the front and rear substrates 111 and 121 into a plurality of discharge cells S, and prevents optical/electrical cross-talk from occurring between the discharge cells S. The barrier rib portion 128 may have a rectangular transverse cross-section and define the discharge cells S as a matrix. In one embodiment, the discharge cells S are arranged in a plurality of columns and a plurality of rows. Each of the discharge cells S may include a main discharge space S1 and a stepped space S2 on both sides of the main discharge space S1.

In one embodiment, as shown in FIG. 1, the barrier rib portion 128 includes transverse barrier ribs 124 which extend in a row direction (a second direction), and longitudinal barrier ribs 126 which extend in a column direction (a first direction) and cross the transverse barrier ribs 124.

Each of the transverse barrier ribs 124 may include a first barrier rib 124*a* and a second barrier rib 124*b*. The second barrier rib 124*b* is formed on the first barrier rib 124*a*. That is, the second barrier rib 124*b* is closer to the front substrate 111 than the first barrier rib 124*a*. In one embodiment, the second barrier rib 124*b* has a width that is less than that of the first barrier rib 124*a*. In one embodiment, the second barrier ribs are greater in height than the first barrier ribs.

In one embodiment, the stepped space S2 is formed with an upper surface of the first barrier rib 124*a* and a side surface of the second barrier rib 124*b*. The main discharge space S1 and the stepped space (or an auxiliary discharge space) S2 which extends from the main discharge space S1 without being interposed by an additional structure may form the discharge cell S. In one embodiment, as shown in FIGS. 1 and 2, each of the first barrier ribs 124*a* has a slanted surface. The slanted surface may be slanted at an angle greater than 90 degrees (i.e., forming an obtuse angle) with respect to the rear substrate 121. In one embodiment, as shown in FIGS. 1 and 2, each of the first barrier ribs comprises a pair of slanted surfaces which face slanted surfaces of adjacent first barrier ribs, respectively.

Since the stepped space S2 is formed with the protruding portions of the first barrier rib 124*a*, the stepped space S2 has a smaller volume than that of the main discharge space S1.

The barrier rib portion 128 may be formed of a material having a permittivity that is greater than a predetermined level so as to form a high address electric field in the stepped space S2 by using the first barrier ribs 124*a*. In addition, patterns of the barrier rib portion 128 may be formed in a photolithography method using a photosensitive material such as a photosensitive organic material.

In one embodiment, the anti-reflection layer 129 is formed on upper portions of the second barrier ribs 124*b*. The anti-reflection layer 129 may be formed to have a black color so as to absorb external light that is incident on the front substrate 111 and to prevent the external light from being reflected. Thus, a contrast of the PDP 100 may be improved.

The anti-reflection layer 129 may be formed of a photosensitive material. In one embodiment, after applying photosensitive material on the upper portions of the second barrier ribs 124*b*, the photosensitive material is exposed to light to form the black anti-reflection layer 129. In one embodiment, when the barrier rib portion 128 is formed of the photosensitive material, an upper surface of the barrier rib portion 128, that is, the upper surfaces of the second barrier ribs 124*b*, is exposed for a predetermined time to easily form the anti-reflection layer 129 of black color.

However, one or more embodiments are not limited to the above example, that is, the black anti-reflection layer 129 may be formed by using various materials.

The anti-reflection layer 129 may also be formed on upper portions of the longitudinal barrier ribs 126 so as to absorb the external light which is incident on the front substrate 111 of the PDP 100 and to prevent the external light from being reflected. Thus, the contrast of the PDP 100 may be improved.

In one embodiment, discharge electrodes 112 are disposed on the front substrate 111. Each of the discharge electrodes 112 may include an X electrode and a Y electrode, and the discharge electrodes 112 may be disposed substantially in parallel to each other in the row direction with a predetermined interval therebetween. When a voltage is applied to the X and Y electrodes, the X and Y electrodes generate a discharge. The X and Y electrodes may respectively include transparent electrodes Xa and Ya and bus electrodes Xb and Yb. The transparent electrodes Xa and Ya may be formed of a transparent conductive material which does not block the light that emits from the phosphor 125 toward the front substrate 111, for example, a transparent conductive material including an indium tin oxide (ITO). However, since the transparent conductive material such as the ITO generally has a large resistance, when the discharge electrode 112 only includes the transparent electrodes Xa and Ya, lengths of the transparent electrodes Xa and Ya are increased. Then, a voltage drop in the length direction of the transparent electrodes increases, and thus, the power consumption of the transparent electrodes increases and the response speed of the transparent electrodes increases. In one embodiment, in order to address the above-described problem, the bus electrodes Xb and Yb which are formed of a metal material and have narrower widths than those of the transparent electrodes Xa and Ya are disposed on the transparent electrodes Xa and Ya, respectively.

Here, the bus electrodes Xb and Yb may include an external light absorbing material. The bus electrodes Xb and Yb may absorb the external light incident on the front substrate 111 to prevent the external light from being reflected. In order to absorb the external light, the bus electrodes Xb and Yb may include a material having a high blackness, and may include a single-layered structure or a multi-layered structure. Thus, the bus electrodes Xb and Yb may include cobalt, ruthenium, or manganese. In one embodiment, the transparent electrodes Xa and Ya and the bus electrodes Xb and Yb are formed using a photo-etching method or a photolithography method. Here, the transparent electrodes Xa and Ya may be formed to extend in the row direction, to be rectangular, or in other various shapes. The bus electrodes Xb and Yb may be formed using an offset printing method.

In addition, the X and Y electrodes may be alternately disposed, or may be disposed to face the same kind of electrode in neighboring discharge cells S. In one embodiment, as shown in FIG. 1, the X and Y electrodes are arranged in an order of Y, X, X, and Y electrodes so that the same kinds of electrodes included in two neighboring discharge cells S face each other. Therefore, a wrong discharge, that is, the sustain discharge occurs out of the boundary between the discharge cells S, may be prevented, and a reactive power consumption may be reduced and a driving efficiency of the PDP may be improved.

The front dielectric layer 115 may be formed on the front substrate 111 and cover the discharge electrodes 112. The front dielectric layer 115 is formed to prevent the adjacent transparent electrodes Xa and Ya from short-circuiting, and at the same time, to prevent electrons from directly colliding with the discharge electrodes 112 and damaging the discharge electrodes 112. In addition, the front dielectric layer 115 may induce electric charges to generate wall charges easily. The front dielectric layer 115 may be formed of $SiO_2$, PbO, or a material mixed with a ceramic material based on $Al_2O_3$, wherein $SiO_2$, PbO have excellent dielectric properties.

The protective layer 116 may be formed on the front dielectric layer 115 that is on the front substrate 111. The protective layer 116 is formed to prevent positive ions and electrons from colliding with the front dielectric layer 115 and damaging the front dielectric layer 115, and to increase ejection of secondary electrons in the discharge cells S when the PDP 100 is discharged. The protective layer 116 may be formed of a material including MgO, which is a ferroelectric material having excellent voltage-resistance properties, and may be formed as a thin film using sputtering or electron beam deposition.

In one embodiment, the address electrodes 122 formed in a predetermined pattern are formed on the rear substrate 121 facing the front substrate 111. The address electrodes 122 may extend across the discharge cells S in the column direction and cross the discharge electrodes 112 on the front substrate 111. The address electrodes 122 generate the address discharge which facilitates the sustain discharge between the discharge electrodes 112; in more detail, reduce a voltage which causes the sustain discharge.

The rear dielectric layer 123 may be formed on the rear substrate 121 and cover the address electrodes 122. The rear dielectric layer 123 prevents the electrons from colliding with the address electrodes 122 and damaging the address electrodes 122 when the discharge occurs, and induces electric charges. The rear dielectric layer 123 may be formed of PbO, $B_2O_3$, or $SiO_2$.

The phosphor 125 is applied on the rear dielectric layer 123 which is formed on the rear substrate 121. The phosphor 125 may include a red phosphor, a green phosphor, and a blue phosphor. The phosphor 125 may include a material which receives vacuum ultraviolet (UV) rays to generate visible rays. The red phosphor 125 may include a red phosphor material such as $Y(V, P)O_4$: Eu, the green phosphor 125 may include a green phosphor material such as $Zn_2SiO_4$: Mn or $YBO_3$: Tb, and the blue phosphor 125 may include a blue phosphor material such as BAM: Eu.

The phosphor 125 may be formed on exposed upper surfaces of the rear dielectric layer 123, the exposed upper and side surfaces of the first barrier ribs 124*a*, and the side surfaces of the second barrier ribs 124*b*, and thus, may be continuously formed in the main discharge spaces S1 and the stepped spaces S2. The phosphor 125 may be formed by applying a phosphor paste to rows of the discharge cells S.

In particular, the phosphor 125 formed on exposed upper surfaces of the first barrier ribs 124*a*, that is, surfaces of the first barrier ribs 124*a* which form the stepped space S2, is adjacent to the X and Y electrodes generating the sustain discharge, and thus, the phosphor 125 on that portion may be effectively excited. In addition, the phosphor 125 is adjacent to the front substrate 111 which forms a display screen of the PDP and is oriented toward a third direction shown in FIGS. 1 and 2, and thus, the visible rays generated by the phosphor 125 may be directly output to the outside of the PDP, and accordingly, an efficiency of extracting visible rays may be improved.

In addition, since a general phosphor is attached to side surfaces of barrier ribs in a typical PDP device, a phosphor paste which is flexible flows downward due to gravity, and accordingly, the thickness of the phosphor remaining on the side surfaces of the barrier ribs may be reduced or become non-uniform. In addition, since the visible rays are emitted toward the side surfaces of the barrier ribs, the light extracting efficiency is lowered. However, according to the present embodiment, since the second barrier ribs (or second sub-barrier ribs) 124*b* have narrower widths than those of the first barrier ribs (or first sub-barrier ribs) 124*a*, a stepped structure may be formed. Accordingly, the phosphor paste 125 may be fixed on the surfaces of the barrier rib portion 128 stably.

A discharge gas, for example, a mixture of neon (Ne) and xenon (Xe), is filled in each of the discharge cells S. Here, the Xe gas may be mixed in the discharge gas in a high ratio.

Once the discharge gas is filled in the discharge cells S, the front substrate 111 and the rear substrate 121 are sealed with each other with a sealing member such as frit glass formed on edges of the front and rear substrates 111 and 121.

The operations and effects of the PDP 100 having the above-described structure according to one embodiment of the present invention will be described as follows.

When an address voltage is applied between the address electrode 122 and the Y electrode of the discharge electrode 112, an address discharge occurs, and accordingly, a discharge cell S in which the sustain discharge will be generated is selected as a result of the address discharge. The address discharge is an auxiliary discharge which accumulates priming particles in each of the discharge cells S prior to the sustain discharge to help a display discharge. In one embodiment, the address discharge is mainly generated in the stepped space S2 which is formed with the transverse barrier rib 124. In one embodiment, the Y electrode and the address electrode 122 cross each other on a portion overlapping with the stepped space S2, or at least on a portion adjacent to the stepped space S2. The discharge voltage applied between the Y electrode and the address electrode 122 may be concentrated in the stepped space S2 via the front dielectric layer 115 or the protective layer 116 covering the Y electrode, or the transverse barrier rib 124 on the address electrode 122 to form a high electric field which is sufficient enough to start the discharge in the stepped space S2.

In a typical PDP, the discharge between a Y electrode and an address electrode is generated through a discharge path corresponding to a height of a discharge cell. In one embodiment, the first barrier ribs 124*a* are formed to a predetermined height toward the Y electrodes. Therefore, the discharge path between the Y electrode and the address electrode 122 is reduced to a distance g between the phosphor 125 on upper surfaces of the first barrier ribs 124*a* and the protective layer 116. Therefore, in one embodiment, the same amount of priming particles may be generated with a lower address voltage than that of the typical PDP, and thus, driving power consumption may be reduced. In addition, in one embodiment, more priming particles may be generated with the same address voltage as that of the typical PDP, and thus, light emitting efficiency may be improved.

The thickness of each of the first barrier ribs 124*a* may be determined appropriately. That is, if the thickness of the first barrier rib 124*a* is increased, the address voltage is reduced and the excitation of the phosphor 125 may be increased. However, if the first barrier rib 124*a* is too thick, the upper surface of the first barrier rib 124*a* infiltrates into a discharge path P between the Y and X electrodes, and thus, discharge interference occurs and the sustain voltage may be increased. Therefore, the thickness of the first barrier rib 124*a* may be determined according to fabrication processes, a size of the PDP, and specifications of the PDP.

When the sustain voltage is applied between the X and Y electrodes of the selected discharge cell S, the sustain voltage is generated. At this time, the priming particles generated by the address discharge in the stepped space S2 are dispersed toward the main discharge space S1 to participate in the sustain discharge.

The stepped space S2 may be formed on both sides of the main discharge space S1, that is, on the Y electrode side and the X electrode side. While the address discharge is generated in the stepped space S2 on the Y electrode side, the stepped space S2 on the X electrode side is formed to balance with the stepped space S2 on the Y electrode side. In one embodiment, the discharge cell S is designed to have substantially symmetric left and right sides. As a result, the sustain discharge may be generated substantially symmetrically on the Y and X electrode sides with the same discharging intensities. Therefore, a brightness distribution in the discharge cell S may be substantially symmetric, a light emitting center roughly coincides with a geometrical center of the discharge cell S, and a degradation of image display quality caused by asymmetric brightness distribution may be prevented.

When the sustain discharge occurs, an energy level of the excited discharge gas is lowered to emit UV rays. Then, the UV rays excite the phosphor 125 applied in the discharge cell S, and then, the energy level of the excited phosphor 125 is reduced to emit visible rays which form an image. At this time, the emitted visible rays transmit through the front panel 110 so that a user of the PDP 100 may recognize the visible rays.

When the PDP 100 is used, a lot of external light is incident on the PDP 100. In particular, the external light is mainly incident on the front substrate 111. The anti-reflection layer 129 may be formed on the upper portions of the second barrier ribs 124*b* to absorb the external light. The anti-reflection layer 129 may be also formed on the longitudinal barrier ribs 126 to increase the absorption of external light, and accordingly, the contrast of the PDP 100 may be improved. In addition, since the bus electrodes Xb and Yb of the PDP 100 include external light absorbing material, the contrast of the PDP may be further improved.

In addition, in the general PDP including the discharge gas, in which the Xe gas is mixed in a high mixture ratio, a discharge starting voltage is necessary, and accordingly, there is a limitation in applying the PDP to various fields. For example, the driving power consumption increases and a circuit is to be redesigned in order to increase a rated voltage. However, according to one embodiment, the high electric field, which is advantageous for generating the address discharge, is formed in the stepped space S2, and accordingly, a sufficient amount of priming particles which are necessary to start the discharge may be ensured. In addition, without excessively increasing a discharge starting voltage, a PDP of high-Xe may be realized, and thus, light emitting efficiency may be improved greatly.

Figure 3:
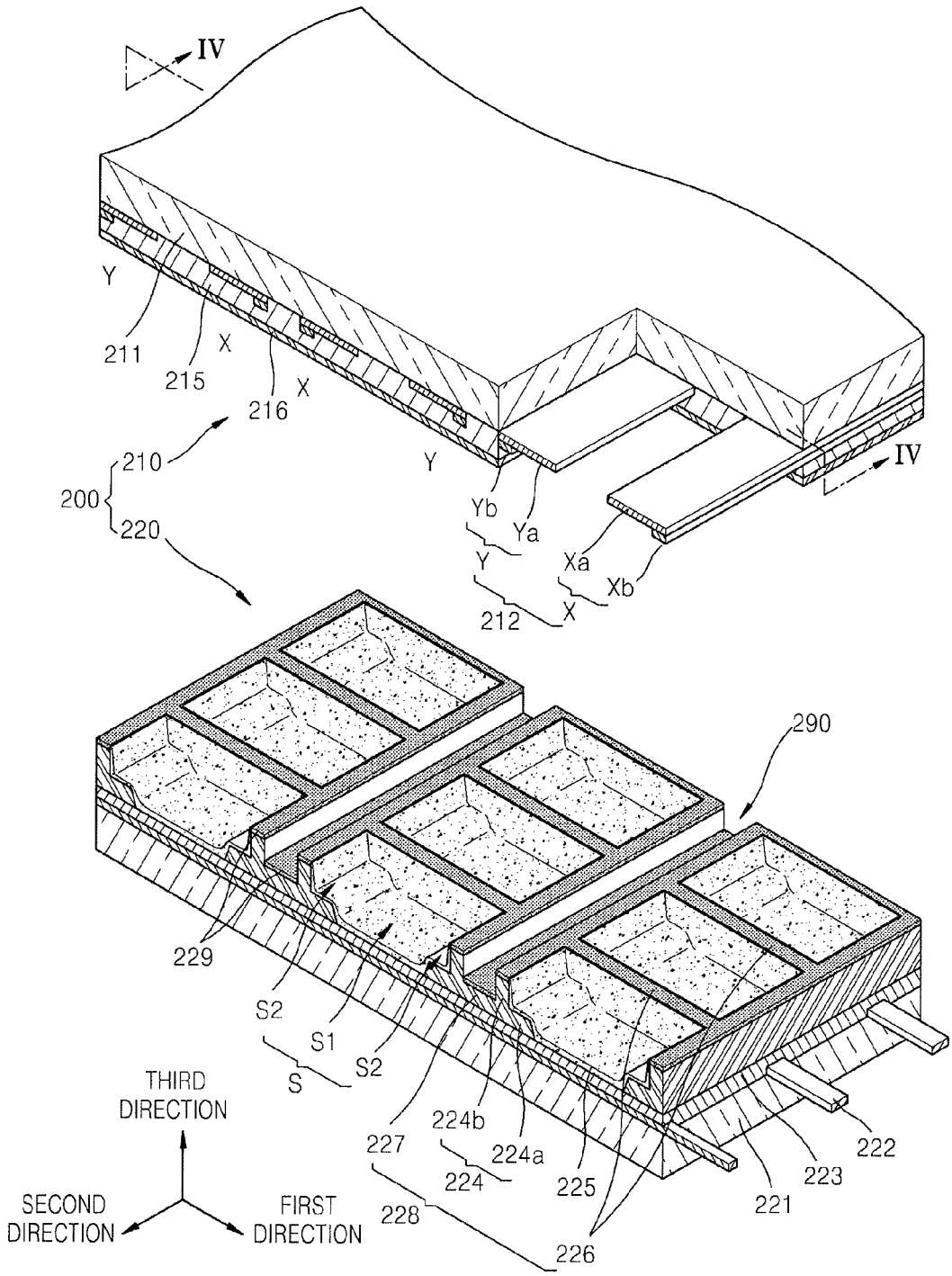
FIG. 3 is a schematic perspective view of a PDP according to another embodiment of the present invention.
Figure 4:
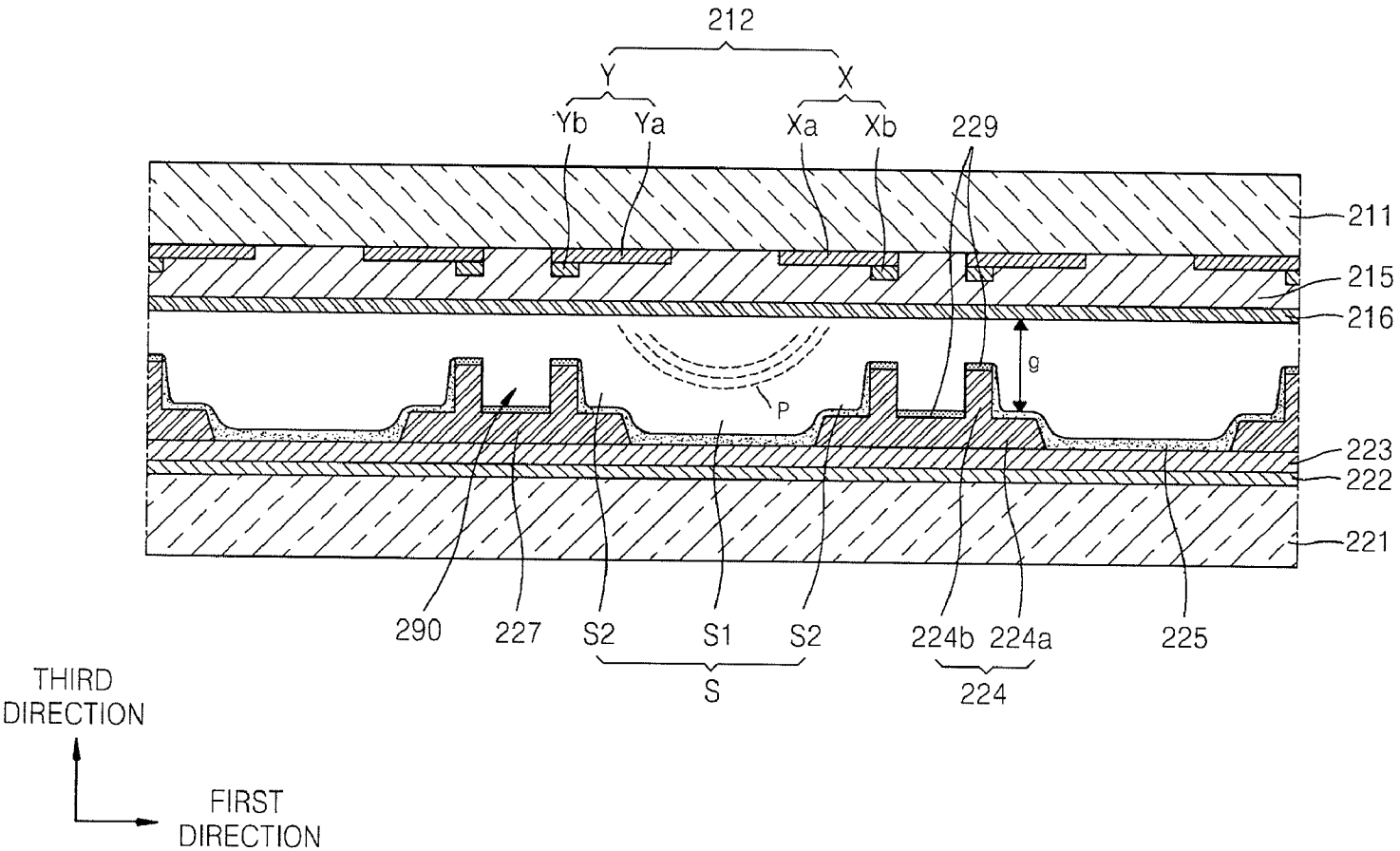
FIG. 4 is a cross-sectional view of the PDP taken along line IV-IV of FIG. 3.

FIG. 3 is a perspective view of a PDP 200 according to another embodiment of the present invention, and FIG. 4 is a cross-sectional view of the PDP 200 taken along line IV-IV of FIG. 3.

The PDP 200 includes a front panel 210 and a rear panel 220 which face each other. The front panel 210 may include a front substrate 211, discharge electrodes 212, a front dielectric layer 215, and a protective layer 216. The rear panel 220 may include a rear substrate 221, address electrodes 222, a rear dielectric layer 223, a barrier rib portion 228, a phosphor 225, and an anti-reflection layer 229. A discharge gas is filled in a space between the front panel 210 and the rear panel 220. Hereinafter, elements of the present embodiment that are different from those of the embodiment shown in FIGS. 1 and 2 will be described in more detail.

The barrier rib portion 228 is disposed between the front substrate 211 and the rear substrate 221.

The barrier rib portion 228 is disposed between the front and rear substrates 211 and 221 to divide the space between the front and rear substrates 211 and 221 into a plurality of discharge cells S and non-discharge areas 290, and prevents optical/electrical cross talk from generating between the discharge cells S. The discharge cells S are arranged in a plurality of rows and a plurality of columns. Each of the discharge cells S may include a main discharge space S1 and a stepped space S2 on both sides of the main discharge space S1.

In one embodiment, as shown in FIG. 3, the barrier rib portion 228 includes transverse barrier ribs 224 which extend in a row direction (a second direction), and longitudinal barrier ribs 226 which extend in a column direction (a first direction) and cross the transverse barrier ribs 224. The longitudinal barrier ribs 226 are separated from each other to define the discharge cells S which are arranged in a first direction, and the non-discharge areas 290 are formed in regions between the longitudinal barrier ribs 226.

A lot of impure gas may exist in the discharge cells S due to plasma discharge. In addition, the impure gas is to be removed whenever the discharge occurs. In the present embodiment, the impure gas may be easily exhausted through the non-discharge areas 290. Since the impure gas is exhausted and the discharge gas is not mixed with the impure gas, the discharging efficiency of the PDP 200 may be improved and an image quality of the PDP 200 may be improved.

Each of the transverse barrier ribs 224 may include a first barrier rib 224*a* and a second barrier rib 224*b* that is formed on the first barrier rib 224*a*. That is, the second barrier rib 224*b* is closer to the front substrate 211 than the first barrier rib 224*a*. The second barrier rib 224*b* has a width smaller than that of the first barrier rib 224*a*.

In one embodiment, the stepped space S2 is formed with surfaces of the first and second barrier ribs 224*a* and 224*b*. In one embodiment, the anti-reflection layer 229 is formed on upper portions of the second barrier ribs 224*b*. The anti-reflection layer 229 may have a black color to absorb the external light to prevent the external light from being reflected when the external light is incident on the front substrate 211. Therefore, the contrast of the PDP 200 is improved.

The anti-reflection layer 229 may be formed of a photosensitive material. That is, after applying the photosensitive material, the photosensitive material is exposed to form the black anti-reflection layer 229. In one embodiment, when the barrier rib portion 228 is formed of a photosensitive material, an upper portion of the barrier rib portion 228, that is, upper surfaces of the second barrier ribs 224*b*, is exposed for a predetermined time to easily fabricate the anti-reflection layer 229 of black color.

However, the anti-reflection layer 229 is not limited to the above example, that is, the anti-reflection layer 229 may be formed of various materials.

The anti-reflection layer 229 may be also formed on upper portions of the longitudinal barrier ribs 226 in order to absorb the external light which is incident on the front substrate 211 of the PDP 200 and to prevent the external light from being reflected. Therefore, the contrast the PDP 200 may be further improved.

The discharge electrodes 212 may be disposed on the front substrate 211. Each of the discharge electrodes 212 may include an X electrode and a Y electrode, which respectively include transparent electrodes Xa and Ya and bus electrodes Xb and Yb. In one embodiment, the bus electrodes Xb and Yb, which are formed of a metal material to have a narrower width than those of the transparent electrodes Xa and Ya, are disposed on the transparent electrodes Xa and Ya, respectively. The structures and fabrication processes of the transparent electrodes Xa and Ya and the bus electrodes Xb and Yb are the same as those of the previous embodiment, and thus detailed descriptions thereof are not provided here.

The front dielectric layer 215 is formed on the front substrate 211 and covers the discharge electrodes, and the protective layer 216 may be further formed on the front dielectric layer 215.

On the rear substrate 221 facing the front substrate 211, the address electrodes 222 are disposed in a predetermined pattern. The address electrodes 222 extend across the discharge cells S and cross the discharge electrodes 212 on the front substrate 211. The rear dielectric layer 223 may be formed on the rear substrate 221 and cover the address electrodes 222.

The phosphor 225 is applied on the rear dielectric layer 223 formed on the rear substrate 221. The phosphor 225 may include a red phosphor, a green phosphor, and a green phosphor. The phosphor 225 may be formed by continuously applying a phosphor paste on a row of the discharge cells S. The phosphor 225 may not be applied on the non-discharge areas 290.

The discharge gas, for example, a mixture of Ne and Xe, is filled in the discharge cells S. Here, the Xe gas may be mixed in the discharge gas in a high ratio.

The front substrate 211 and the rear substrate 221 may be sealed with each other with a sealing member such as frit glass formed on edges of the front and rear substrates 211 and 221.

The anti-reflection layer 229 may be formed on the non-discharge areas 290 of the present embodiment. The anti-reflection layer 229 formed on the non-discharge areas 290 may prevent the external light which is incident on the front substrate 221 from being reflected by the non-discharge areas 290. Therefore, the contrast of the PDP 200 is improved.

In addition, a third barrier rib 227 may be formed on a bottom surface of each of the non-discharge areas 290. The third barrier rib 227 may extend from the first barrier rib 224*a*. The anti-reflection layer 229 may be formed on upper portions of the third barrier ribs 227. As described in the previous embodiment, if the third barrier rib 227 is formed of a photosensitive material, the anti-reflection layer 229 may be formed easily by performing an exposure process on an upper surface of the third barrier rib 227. Otherwise, the anti-reflection layer 229 may be formed of a material which is different from that of the third barrier rib 227.

According to a PDP of one or more embodiments of the present invention, the contrast of the PDP may be improved by preventing external light from being reflected. In addition, the visible ray extracting efficiency of the PDP may be improved, an address voltage may be reduced, and the efficiency of driving the PDP may be improved.

It should be understood that the exemplary embodiments described therein should be considered in a descriptive sense only and not for purposes of limitation. Descriptions of features or aspects within each embodiment should typically be considered as available for other similar features or aspects in other embodiments.

What is claimed is:

1. A plasma display panel (PDP) comprising:

a front substrate and a rear substrate spaced apart from and facing each other;

a barrier rib portion dividing a space between the front substrate and the rear substrate into a plurality of discharge cells, wherein the barrier rib portion comprises first barrier ribs and second barrier ribs formed on the first barrier ribs, wherein the second barrier ribs are less in width than the first barrier ribs, wherein the widths of the first and second barrier ribs are defined along a first direction, and wherein the second barrier ribs are closer to the front substrate than the first barrier ribs;

an anti-reflection layer formed on the second barrier ribs;

a plurality of discharge electrodes disposed on the front substrate substantially in parallel with each other across the front substrate;

a plurality of address electrodes formed on the rear substrate to cross the discharge electrodes;

phosphors formed in the discharge cells; and a discharge gas filled in the discharge cells.

2. The PDP of claim 1, wherein the second barrier ribs are greater in height than the first barrier ribs, and wherein the heights of the first and second barrier ribs are defined along a second direction substantially perpendicular to the first direction.

3. The PDP of claim 1, wherein the space comprises a main discharge space and an auxiliary discharge space, wherein the volume of the main discharge space is greater than that of the auxiliary discharge space, wherein the first barrier ribs are substantially symmetrically disposed on both sides of the main discharge space in the discharge cells, and wherein the auxiliary discharge space comprises stepped surfaces of the first barrier ribs and the second barrier ribs.

4. The PDP of claim 3, wherein the main discharge space and the auxiliary discharge space are connected to each other to form each of the discharge cells.

5. The PDP of claim 1, wherein each of the discharge electrodes comprises a pair of transparent electrodes and a pair of bus electrodes, and wherein each of the bus electrodes comprises an external light absorbing material.

6. The PDP of claim 1, wherein the barrier rib portion comprises i) transverse barrier ribs which extend in a direction and include the first barrier ribs and the second barrier ribs, and ii) longitudinal barrier ribs extending in a direction different to the transverse barrier ribs.

7. The PDP of claim 6, wherein the anti-reflection layer is formed on the longitudinal barrier ribs.

8. The PDP of claim 1, wherein the barrier rib portion comprises a photosensitive material.

9. The PDP of claim 1, wherein non-discharge areas are formed adjacent to the discharge cells, and wherein the anti-reflection layer is formed on the non-discharge areas.

10. The PDP of claim 9, further comprising third barrier ribs extending from the first barrier ribs on bottom surfaces of the non-discharge areas, wherein the anti-reflection layer is formed on upper portions of the third barrier ribs.

11. The PDP of claim 1, wherein the anti-reflection layer is black in color.

12. A plasma display panel (PDP) comprising:

first and second substrate spaced apart from and opposing each other, wherein the first substrate is configured to display an image;

a barrier rib formed between the first and second substrates and defining a plurality of discharge cells, wherein the barrier rib comprises a plurality of first sub-barrier ribs and a plurality of second sub-barrier ribs, wherein each of the second sub-barrier ribs comprises i) a bottom surface connected to the respective first sub-barrier rib and ii) a top surface opposing the bottom surfaces, wherein the top surface is closer to the first substrate than the bottom surface, and wherein each of the first sub-barrier ribs comprises a slanted surface; and an anti-reflection layer formed on the top surfaces of the second sub-barrier ribs.

13. The PDP of claim 12, wherein the second sub-barrier ribs are less in width than the first sub-barrier ribs, wherein the second sub-barrier ribs are greater in height than the first sub-barrier ribs, wherein the widths of the first and second sub-barrier ribs are defined along a first direction substantially parallel with one of the first and second substrates, and wherein the heights of the first and second sub-barrier ribs are defined along a second direction substantially perpendicular to the first direction.

14. The PDP of claim 12, wherein each of the discharge cells comprises a main discharge space and an auxiliary discharge space, wherein the first sub-barrier ribs are substantially symmetrically disposed on both sides of the main discharge space in the discharge cells, and wherein the auxiliary discharge space comprises stepped surfaces of the first sub-barrier ribs and the second sub-barrier ribs.

15. The PDP of claim 14, wherein the volume of the main discharge space is greater than that of the auxiliary discharge space, and wherein the main discharge space and the auxiliary discharge are connected to each other to form each of the discharge cells.

* * * * *